US007650662B2

(12) United States Patent
Kakutani

(10) Patent No.: US 7,650,662 B2
(45) Date of Patent: Jan. 26, 2010

(54) CLEANING BRUSH

(75) Inventor: Masayoshi Kakutani, Kainan (JP)

(73) Assignee: Sanko Co., Ltd., Wakayama (JP)

( * ) Notice: Subject to any disclaimer, the term of this patent is extended or adjusted under 35 U.S.C. 154(b) by 760 days.

(21) Appl. No.: 10/571,468

(22) PCT Filed: Sep. 1, 2005

(86) PCT No.: PCT/JP2005/015978

§ 371 (c)(1),
(2), (4) Date: Mar. 13, 2006

(87) PCT Pub. No.: WO2007/029281

PCT Pub. Date: Mar. 15, 2007

(65) Prior Publication Data

US 2008/0271275 A1 Nov. 6, 2008

(51) Int. Cl.
*A46B 15/00* (2006.01)
*A47L 13/10* (2006.01)

(52) U.S. Cl. ..... 15/164; 15/207.2; 15/211; 15/226; 15/176.1; 15/159.1

(58) Field of Classification Search ..... 15/147.1, 15/159.1, 164, 171, 173, 174, 176.1, 176.6, 15/207.2, 209.1, 211, 223–226, 229.1, 229.2, 15/229.11, 229.13

See application file for complete search history.

(56) References Cited

U.S. PATENT DOCUMENTS 2,825,084 A * 3/1958 Sanborn ..... 15/210.1
4,145,787 A * 3/1979 Bastian ..... 15/229.5

FOREIGN PATENT DOCUMENTS

JP 50-3362 * 1/1975
JP 11-187933 * 7/1999
JP 2002-10831 * 1/2002

* cited by examiner

*Primary Examiner*—Mark Spisich
(74) *Attorney, Agent, or Firm*—Antonelli, Terry, Stout & Kraus, LLP.

(57) ABSTRACT

A brush using water alone to clean up toilets, baths, kitchens, tableware, kitchen utensils or the like. Phosphate ingredients contained in the higher alcoholic type detergents and non-ionic detergents currently in use do enhance the cleansing effect, but are nutritive substances to plankton and the cause of its abnormal propagation. Resulting pollution of rivers, lakes and marshes, in particular their coasts, has been a social problem to be solved as soon as possible. The present cleaning brush can remove ordinary dirt, stains or the like, without using such pollution-causing detergents.

18 Claims, 8 Drawing Sheets

CLEANING BRUSH

INDUSTRIAL FIELD OF THE INVENTION

The present invention relates to a cleaning brush such as a toilet cleaning brush, a bath cleaning brush, a kitchen cleaning brush, a tableware cleaning brush, a kitchen utensils cleaning brush or the like, all using water but without aid of any detergent, in case of cleaning the ordinary type and/or degree of dirt, soil or the like.

BACKGROUND ART

A variety of the toilet or bath cleaning brushes and the like of this type using water have spread worldwide to be known to all and used everywhere.

The prior art cleaning brushes are intended to operate with aid of any proper detergent, powdery or liquid, that is capable of removing the dirt, soil or the like. In a case, the detergent may either be dusted over the body of a brush, or this body may be soaked in a detergent solution, so that any dirt surface area will be rubbed with such a brush body. In another case, the detergent may directly be dusted over the dirt surface area, before rubbing the latter with the bush body. In any case, the cleansing faculty of a detergent is made use of so as to remove such dirt, soil or the like.

Whenever doing any cleaning operation, an amount of any powdery or liquid classical detergent has been used. The detergent as one ingredient of a sewage has been discarded subsequently together with water, causing environmental pollution and destruction.

On the other hand, certain new kinds of vegetable detergents for tableware or kitchen utensils have recently been becoming popular as a means of protecting users' skins. However, enameled wares such as toilet stools are still cleaned with the older kinds of detergents that will cause a rough skin.

Synthetic detergents now in use may typically be classified into ABS detergents (viz., mineral oil-based detergents), higher alcoholic type detergents and nonionic detergents. ABS detergents are likely to cause dermatitis and/or liver diseases so that application of this type detergents has been vanishing, except for in some cases or occasions. The currently predominant higher alcoholic or nonionic detergents do however contain each an amount of phosphate or the like additives to enhance their washing ability. Such additives that are nutritive sub-stances to plankton will bring about its abnormal vast generation. Rivers, lakes and marshes, in particular the coasts thereof, have thus been polluted to raise a social problem that has to be solved soonest possible.

The detergents that have been used do not only have a bad influence upon earthly environment, but also give rise to human skin troubles. Therefore, it is not desirable for people to do washing or cleaning with bare hands, but is recommendable to do so with gloved hands.

The present applicant has already developed a certain means for effectively resolving these problems, in which the structure of a fiber aggregate as the cleaning member should be specialized. As disclosed in the patent document 1 noted below, such a cleaning member or body need only be impregnated with water before rubbing any dirt or stain. Thus, any detergent is no longer required when cleaning surfaces as exemplified herein above.

The present applicant has also developed already another means, in which the fiber aggregate as the cleaning body should be of a spherical or otherwise massive configuration so as to be attached to the end of a brush handle. Patent document 2 as listed below shows a brush with a grip handle constructed in this manner.

These epoch-making proposals previously made by the present applicant do scarcely need any amount of detergent when cleaning toilets, baths, washstands, kitchens, tableware, kitchen utensils or the like. It is however to be noted that an enormous number of fibers constituting a brush body have not necessarily been bound firmly to each other, thus failing to provide a rigid bundle. Some fibers included in such a brush body are prone to be displaced longitudinally thereof during use, even if they would not be pulled intentionally. Thus, it has been reported that the brush body will gradually lose its original shape as it is used for a long time, thereby resulting in a beat-up brush difficult to use.

Patent Document 1: Japan Laying-Open Gazette No. Hei. 11-187933

Patent Document 2: Japan Laying-Open Gazette No. 2002-10831

DISCLOSURE OF THE INVENTION

Objects to be Achieved

The resent invention was made to resolve the problem just referred to above, by proposing a novel cleaning brush that can be used for a long time without losing its original shape. This novel brush should not cause, during a long use, any change in its convenient and comfort-able use and any noticeable deterioration in its cleansing power.

Means for Achieving the Objects

The present invention provides a novel cleaning brush comprising brush body that is composed of an enormous number of elemental fibers 22, 42 such that a certain number of the fibers have previously been carded and twisted to form strings 23, 43 each of a predetermined desirable thickness. The strings are then trimmed into the same length, arranged in parallel and the fibers in the mid length portion of each string are secured to each other by a sewing, a fusion bonding or the like fixing means 24. Subsequently, these strings are further processed to form the brush body so that owing to such a fixing means all the fibers will be prevented well from longitudinal displacement.

ADVANTAGES AFFORDED HEREIN

As summarized above, the enormous number of fibers 22, 42 are subjected to the fixing means while the strings 23, 43 do remain still in their exploded state, before aggregating to form a mass as the brush body. None of the fibers included in such a mass will slip off it or otherwise move relative to the mass.

A parallel array 25, 45 of such strings each having undergone the step of inhibiting the fibers from relative motions may then be scrolled up to form the mass as the brush body 2. A binder 3 clamps this brush body 2 so as to secure it to one end of a grip handle 1. Any constituent fiber will never slip off or fall off to adversely change the original shape of this brush during its use for a long time. This brush does neither lose its original shape nor cause any change in the users' feeling of comfortable use, but maintain its original cleansing power during a long use.

BEST MODES OF CARRYING OUT THE INVENTION

A first embodiment will now be described referring to the accompanying drawings, in order to make clearer the present invention.

Figure 1:
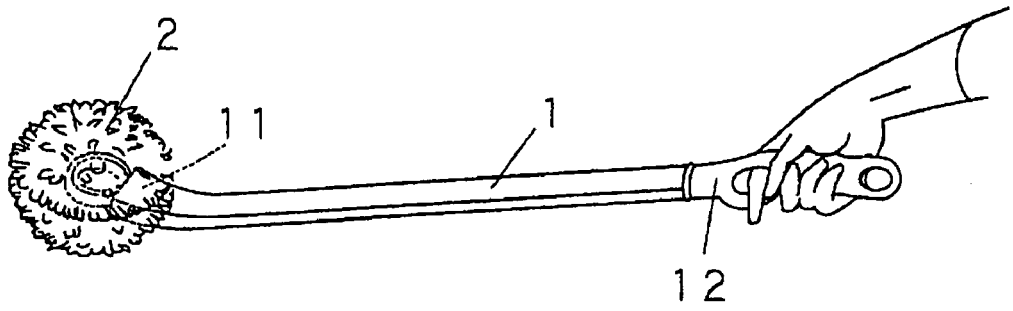
FIG. 1 is a perspective view of a cleaning brush of the present invention, shown in its entirety during use.

FIG. 1 shows a cleaning brush of the invention in its entirety, in which a grip handle 1 is made of a polypropylene resin (PP) and by the injection molding method well known in the art. The handle is generally rod-shaped as seen in FIG. 1, and one of its opposite ends 11 located left-hand in this figure has an opening 13 for holding therein a brush body 2. Binder retaining apertures 14 formed adjacent to the opening 13 and through the side walls do serve to firmly hold a binder in place. A grip 12 shown in the right-hand region of FIG. 1 has an anti-slip surface.

Figure 2:
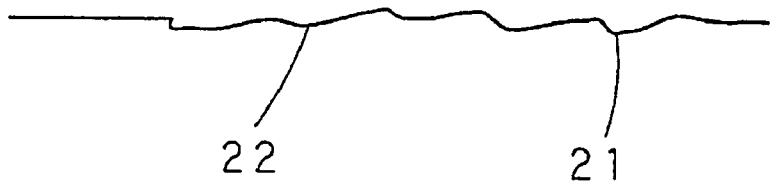
FIG. 2 is a side elevation of one of elemental fibers constituting a brush body.
Figure 3:
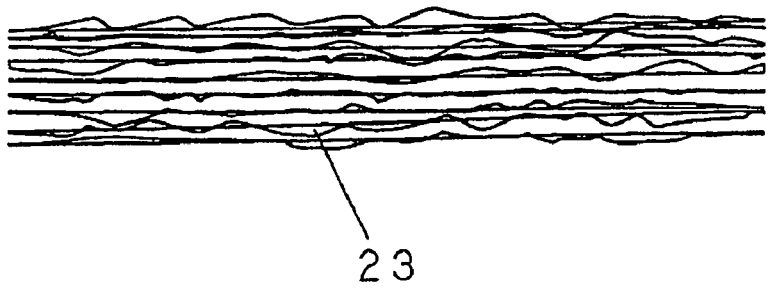
FIG. 3 is a side elevation of one of strings each composed of the elemental fibers but not twisted yet.
Figure 9:
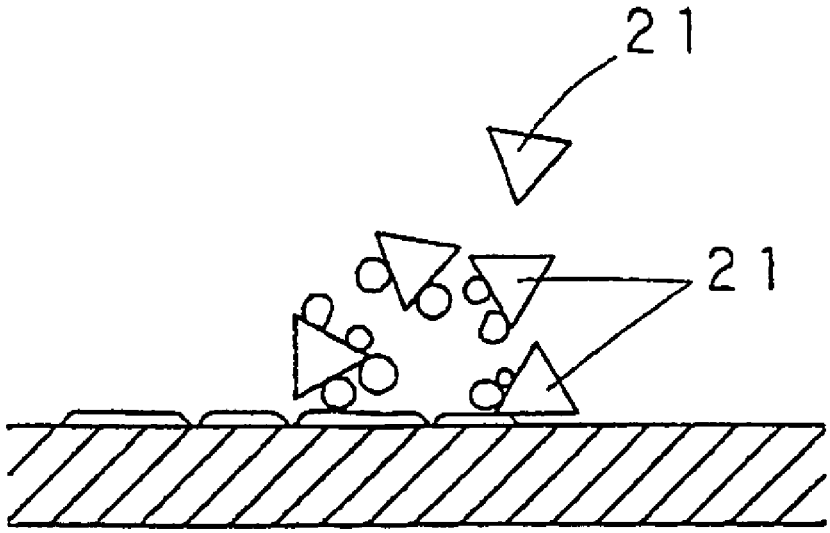
FIG. 9 is an enlarged schematic figure showing a cleaning mechanism that is being done with the brush body.
Figure 10:
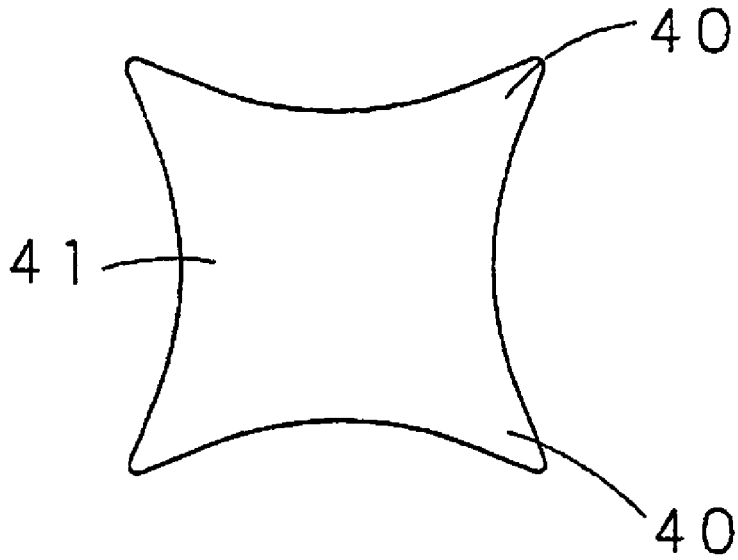
FIG. 10 is an enlarged cross section of a monofilament used in another embodiment.

The brush body 2 is a mass or lump composed of an enormous number of thin fibers. These fibers are monofilaments formed of a polyester resin by using an extrusion die or nozzle that has formed therein some holes each of a special configuration. As enlarged in FIG. 9, each monofilament is generally of an equilateral-triangular cross section with sharp vertexes. Each monofilament 21 has been drawn to be from 30 to 40 denier thick, and crimped to give an elemental fiber 22 as illustrated in FIG. 2. A number of such monofilaments are then carded as seen in FIG. 3, before twisted loosely to result in a string 23 that shows the thickness or diameter of from about 4 to 6 mm in its non-compressed state.

Figure 4A:
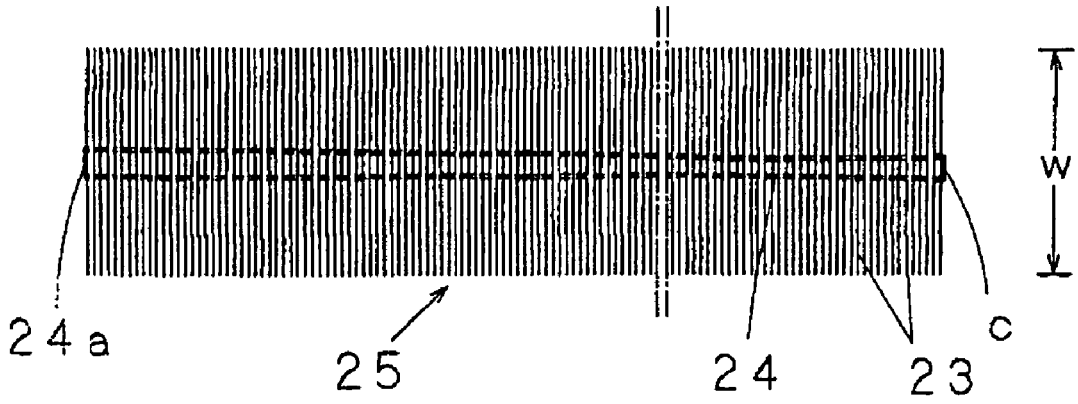
FIG. 4*a* is a plan view of the strings arranged parallel to form an array, with the fibers in each string having been fixed in position.
Figure 4B:
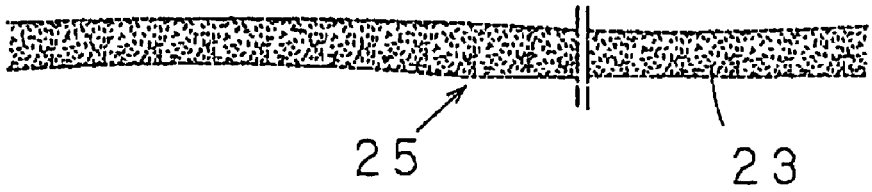
FIG. 4*b* is a side elevation of the strings and fibers as shown in FIG. 4*a*.

The strings 23 each prepared in this manner and all cut into the length of for example 80 mm will then be arranged side by side in parallel with each other to form an array shown in FIG. 4. This array having a width 'w' of about 80 mm is sewn at its middle region 'c' in the direction of 'w', using a sewing machine. Two seams or stitches thus separated a small distance one from another do function as a fiber fixing means 24. By virtue of this fixing means applied at this stage of manufacture to the brush body, every elemental fiber 22 in each string 23 will be protected in use from slipping off or falling off and any other disorderly displacement. An end 24*a* of such a sewn region is molten and then solidified in order to inhibit the outermost string 23 from getting out of shape at that end.

Figure 5A:
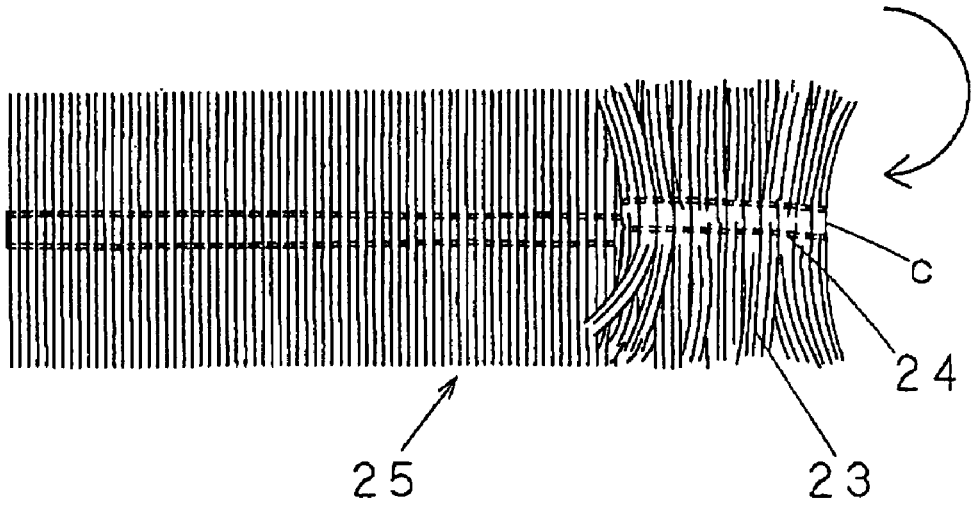
FIG. 5*a* is a plan view of the strings in the array that is being wound from one of its ends into the form of a scroll.
Figure 5B:
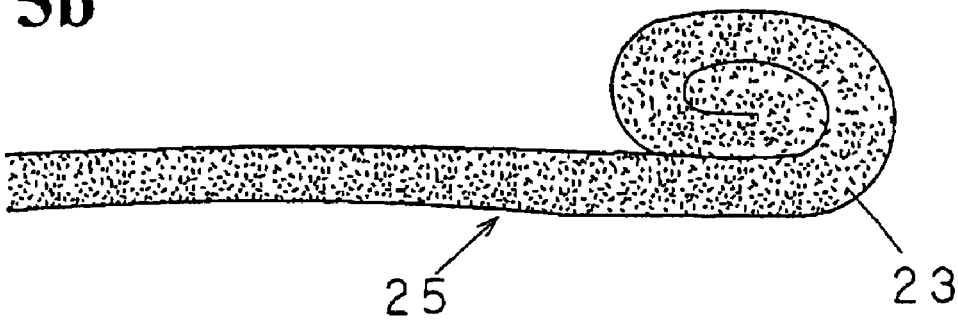
FIG. 5*b* is a side elevation of the strings as shown in FIG. 5*a*.
Figure 6A:
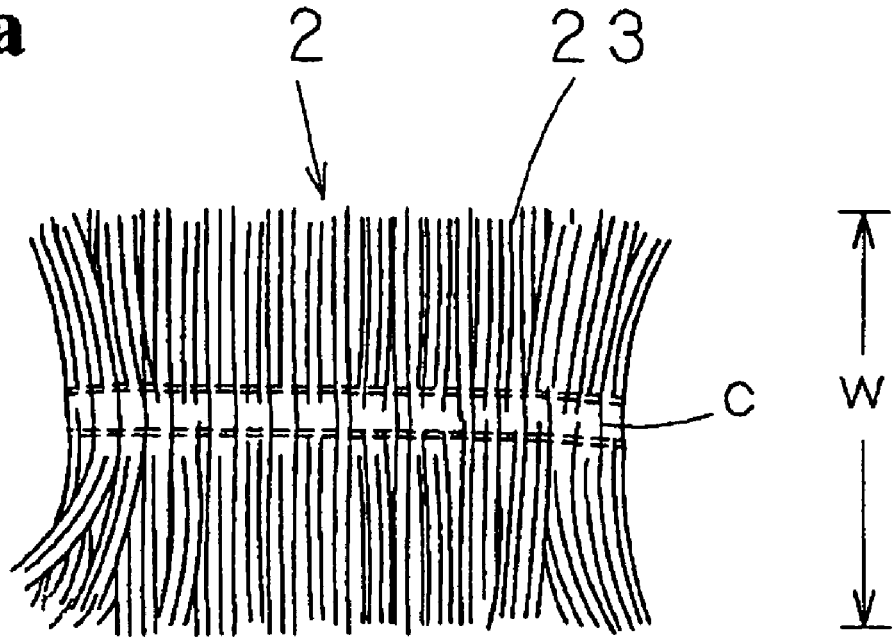
FIG. 6*a* is a plan view of the array of strings that have been wound to form the scroll.
Figure 6B:
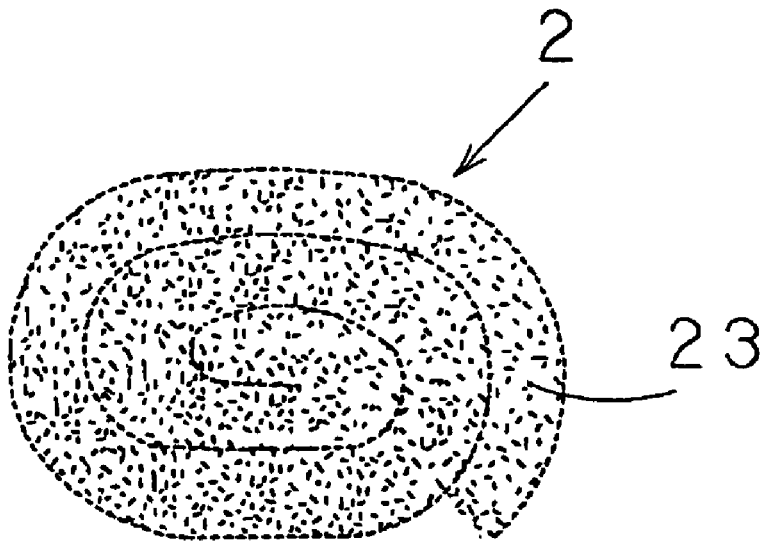
FIG. 6*b* is a side elevation of the array as shown in FIG. 6*a*.

The array 25 of strings thus prepared is then wound up from one of its opposite ends as shown in FIG. 5, so that it finally forms a volute and massive brush body 2 shown in FIG. 6.

Figure 7:
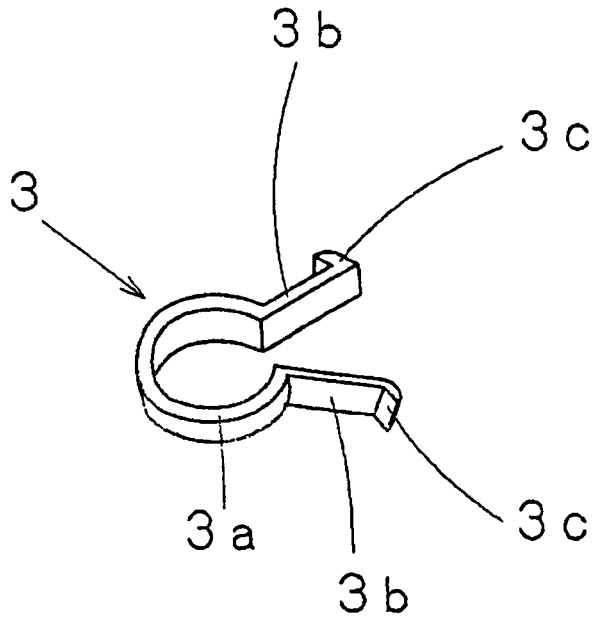
FIG. 7 is a perspective view of a binder for clamping the brush body so as to secure it to a grip handle.
Figure 8:
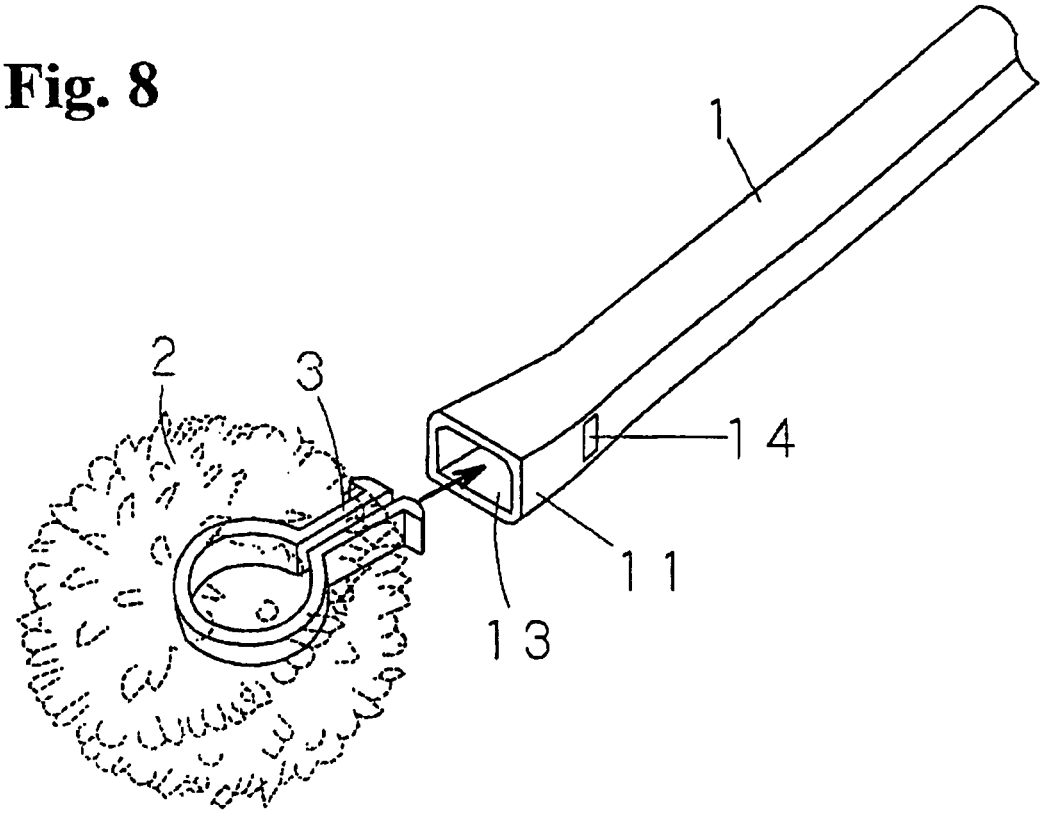
FIG. 8 is a perspective view of the binder having bound the brush body and just being attached to the handle in a manner as shown herein.

Subsequent to these steps as mentioned above, the massive brush body 2 will be clamped, at its middle region 'c' in the direction of width 'w', by a binder 3 that is generally Ω-shaped in plan view. As shown in FIG. 7, this binder has a C-shaped main portion 3*a*, a pair of radial legs 3*b* extending outwardly from opposite ends of main portion 3*a*, and outward protrusions 3*c* formed by bending the free ends of legs 3*b* sideways and away from each other. When assembling this brush, the legs 3*b* of binder 3 will be forced into the opening 13 of the end 11 of handle 1, as indicated at the arrow 'a' in FIG. 8. The outward protrusions 3*c* will thus click in the respective apertures 14 of the handle 1 so as to be retained thereon. The binder 3 is an injection molded piece of a Nylon (trademark of certain synthetic polyamides). The cleaning brush has a structure thus prepared in accordance with the first embodiment shown in FIG. 1.

Every elemental fiber 22 in the brush body 2 provided in the first embodiment does have a cross section that is generally equilateral triangle with acute vertexes. These sharp vertexes are capable of rubbing off a surface certain fur or other watery scale, as well as oily or greasy stains sticking to tableware or the like. Such dirt or stains thus rubbed off will be suspended in water entrained in between the fibers so as not to escape outwards. The brush body will not rub the once removed dirt or stains against the surface just cleaned, thereby affording an effective cleaning without aid of any detergent.

FIGS. 10 to 14 illustrate a second embodiment of the present invention. Each drawn monofilament 41 in this embodiment has a generally tetragonal cross section with four ridges 40 protruding outwards as shown in high magnification in FIG. 10.

Figure 11:
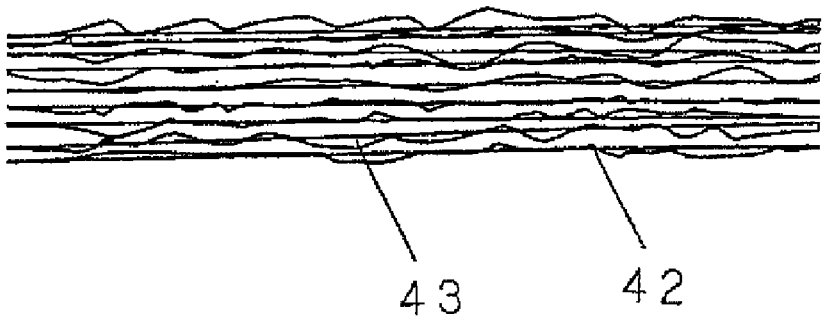
FIG. 11 is a side elevation of one of strings each composed of the elemental fibers but not twisted yet in the another embodiment.

A number of elemental fibers 42 each produced by crimping such a drawn tetragonal monofilament 41 will be oriented side by side as shown in FIG. 11. These fibers are then twisted to provide each of twisted strings 43.

Figure 12:
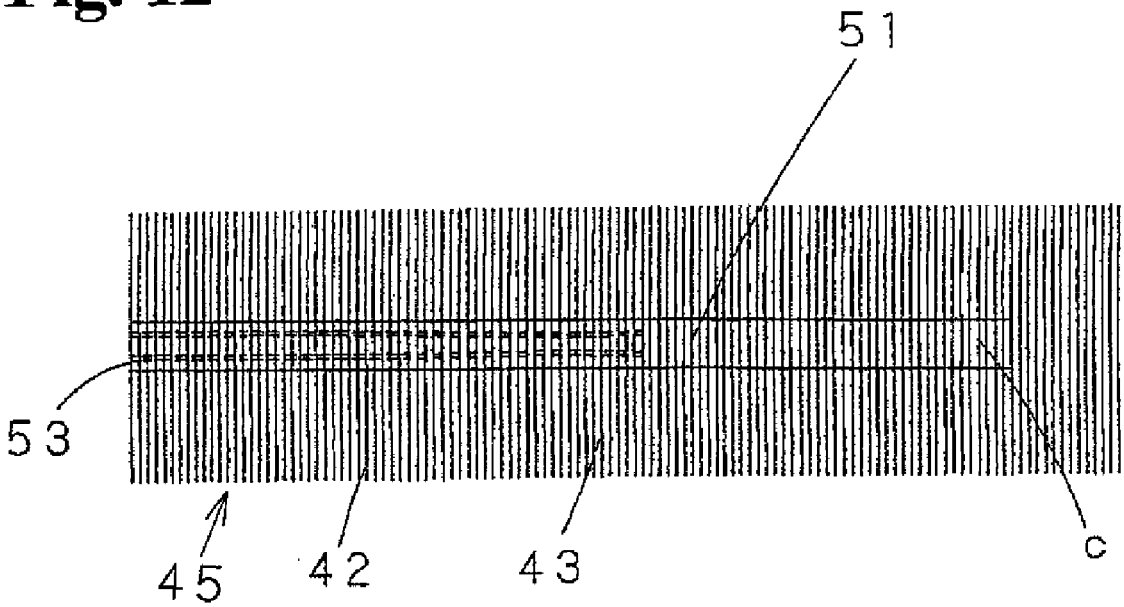
FIG. 12 is a plan view of the strings arranged parallel to form an array, with the fibers in each string having been fixed in position, in the another embodiment.
Figure 13:
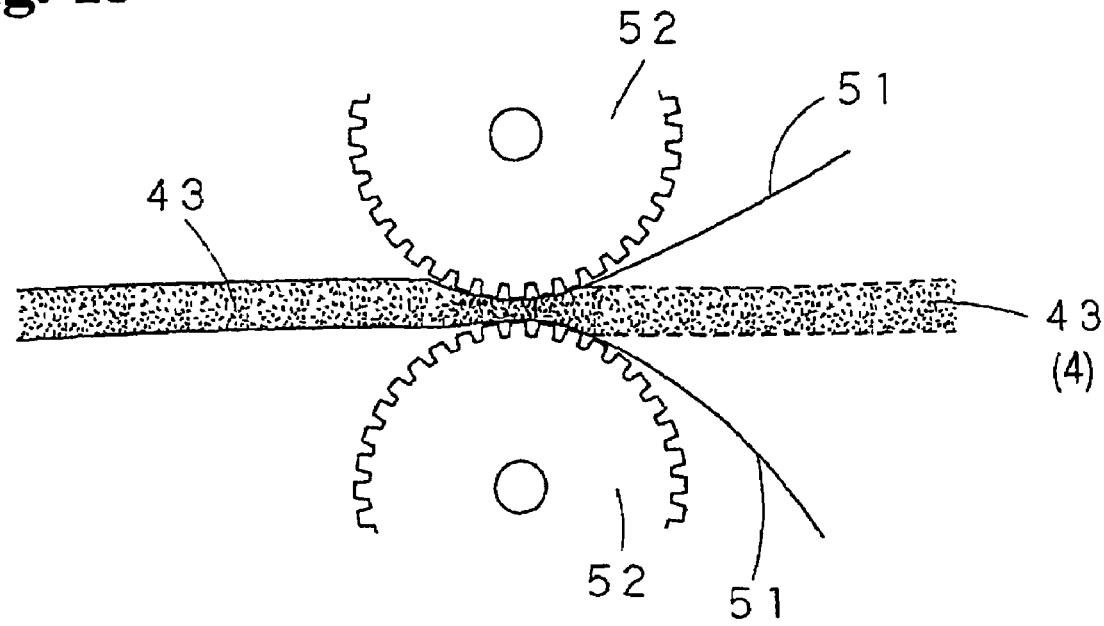
FIG. 13 is a side elevation of a fixing mechanism by which the fibers in each string are being fixed in position in the another embodiment.
Figure 14:
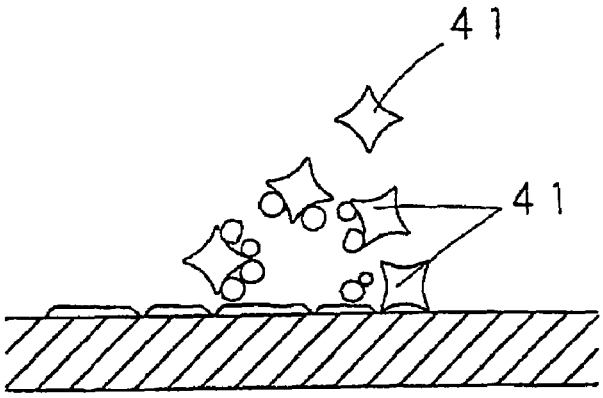
FIG. 14 is an enlarged schematic figure showing the cleaning mechanism that is being done with the brush body in the another embodiment.

FIG. 12 illustrates an array 45 of such strings 43 trimmed into the same length and arranged in parallel. A resin ribbon or knitted tape 51 is applied to both the obverse and reverse of a middle region 'c' of this array in the direction of width 'w'. This array will then be fed in between a pair of thermal press roller 52 having gear-shaped indentations and facing one another as shown in FIG. 13. Thus, the ribbon or tape 51 is molten to be fusion bonded to the strings 43, as indicated at the broken lines 53 in FIG. 12. Every fiber 42 in each string 43 is prevented in this way from slipping off the string. Succeeding steps and other structural features of brush body 2 are the same as described as described in respect of the first embodiment. Alternatively to the example just mentioned above, the ribbon or tape 51 may be applied to either of the obverse and reverse of the string array.

Every elemental fiber 42 in the brush body 2 provided in this way does also have sharp vertexes 40 capable of rubbing off a surface certain fur or other watery scale, as well as oily or greasy stains sticking to tableware or the like. Thus, similarly to the brush body of first embodiment, an effective cleaning is afforded without aid of any detergent.

In order to ensure the effect of washing without using detergent, the monofilaments are preferably formed of a polyester resin, typically a polyethylene terephthalate. The present invention is not necessarily limited to the monofilaments of from 30 to 40 denier, but can be modified to employ thinner or thicker ones within a range of from 20 to 100 denier without affecting the cleansing power.

From the viewpoint of production efficiency, the sewing machine and sewing threads are most preferable as the fiber fixing means. However, one or a pair of thermal gear-shaped rollers designed as described above to carry out the fusion bonding process may substitute well for such a sewing method, also reliably preventing the fibers from slipping off.

The present invention may not necessarily be limited to the non-compressed thickness or diameter of 4 to 6 mm of the strings (as in the above embodiments), but can be modified within a range of from 2 to 10 mm without affecting the anti-slipping off or anti-falling effect.

The material of binder is not restricted to Nylon but may be any other plastics whose rigidity and elasticity are respectively included in proper ranges, or may be any metallic wires, rods or strips.

The material of grip handle also is not restricted to polyolefins such as a polypropylene or a polyethylene, although they can easily be injected into any piece of a desired shape with a neat appearance. Any proper natural materials such as wood sticks or bamboo sticks may be used to manufacture the grip handle.

INDUSTRIAL APPLICABILITY

The present cleaning brush can be used any time without needing any amount of detergent. Except for consolidated stubborn dirt or stains, this brush will operate well with water alone to remove ordinary dirt or stains, thereby eliminating the problem of any environmental pollution. Any constituent fibers of the brush will never slip off the present cleaning brush, and thus it maintains its original shape for a long time of use, so that this brush is expected to spread widely in various fields and societies.

The invention claimed is:

1. A cleaning brush comprising a brush body, a binder and a grip handle, the binder clamping the brush body at its periphery of a middle portion 'c' in the direction of width of the brush body, the binder securing the brush body to an end of the grip handle, characterized in that the brush body is composed of a number of elemental fibers each being a crimped drawn monofilament that has a generally triangular cross section, the elemental fibers are arranged parallel and twisted to form a string, a number of the strings of the same length are arranged in parallel and side by side so that a fiber fixing means is applied to the middle portion 'c' in the direction of width 'w' so as to form an array of the strings, with the fixing means preventing displacement of each elemental fiber, and the array is wound up from one of its opposite ends to form a massive scroll serving as the brush body.

2. A cleaning brush as defined in claim 1, wherein each monofilament is a polyester fiber as exemplified by a polyethylene terephthalate fiber.

3. A cleaning brush as defined in claim 1 wherein each monofilament has a thickness falling within a range of 20 to 100 denier.

4. A cleaning brush as defined in claim 1 wherein the fiber fixing means is the sewing with use of a sewing thread.

5. A cleaning brush as defined in claim 1, wherein the fiber fixing means is a thermal press causing a fusion bonding.

6. A cleaning brush as defined in claim 1, wherein each string has a thickness substantially of 2 to 10 mm in its non-compressed state.

7. A cleaning brush as defined in claim 1, wherein the binder is made of a material selected from a group consisting synthetic resins and metals.

8. A cleaning brush as defined in claim 1 wherein the grip handle is made of a material selected from a group consisting synthetic resins, wood sticks and bamboo sticks.

9. A cleaning brush as defined in claim 8, wherein the grip handle is made of a material selected from a polyolefin group including polypropylenes and polyethylenes.

10. A cleaning brush comprising a brush body, a binder and a grip handle, the binder clamping the brush body at its periphery of a middle portion 'c' in the direction of width of the brush body, the binder securing the brush body to an end of the grip handle, characterized in that the brush body is composed of a number of elemental fibers each being a crimped drawn monofilament that has a generally tetragonal cross section and four ridges protruding radially and outwards, the elemental fibers are arranged parallel and twisted to form a string, a number of the strings of the same length are arranged in parallel and side by side so that a fiber fixing means is applied to the middle portion 'c' in the direction of width 'w' so as to form an array of the strings, with the fixing means preventing displacement of each elemental fiber, and the array is wound up from one of its opposite ends to form a massive scroll serving as the brush body.

11. A cleaning brush as defined in claim 10, wherein each monofilament is a polyester fiber as exemplified by a polyethylene terephthalate fiber.

12. A cleaning brush as defined in claim 10, wherein each monofilament has a thickness falling within a range of 20 to 100 denier.

13. A cleaning brush as defined in claim 10, wherein the fiber fixing means is the sewing with use of a sewing thread.

14. A cleaning brush as defined in claim 10, wherein the fiber fixing means is a thermal press causing a fusion bonding.

15. A cleaning brush as defined in claim 10, wherein each string has a thickness substantially of 2 to 10 mm in its non-compressed state.

16. A cleaning brush as defined in claim 10, wherein the binder is made of a material selected from a group consisting synthetic resins and metals.

17. A cleaning brush as defined in claim 10, wherein the grip handle is made of a material selected from a group consisting synthetic resins, wood sticks and bamboo sticks.

18. A cleaning brush as defined in claim 17, wherein the grip handle is made of a material selected from a polyolefin group including polypropylenes and polyethylenes.

* * * * *